US007556006B2

(12) United States Patent
Eguchi et al.

(10) Patent No.: US 7,556,006 B2
(45) Date of Patent: Jul. 7, 2009

(54) VALVE MECHANISM OF ENGINE

(75) Inventors: Masataka Eguchi, Saitama (JP); Yosuke Hoi, Saitama (JP); Kazuhiko Tomoda, Saitama (JP); Michio Izumi, Saitama (JP); Kazuhiro Shimazaki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 220 days.

(21) Appl. No.: 11/790,050

(22) Filed: Apr. 23, 2007

(65) Prior Publication Data

US 2007/0251480 A1 Nov. 1, 2007

(30) Foreign Application Priority Data

Apr. 26, 2006 (JP) ..... 2006-121637

(51) Int. Cl.
*F01L 1/14* (2006.01)

(52) U.S. Cl. ..... 123/90.48; 123/90.67; 29/888.43; 74/569

(58) Field of Classification Search ..... 123/90.39, 123/90.44, 90.48, 90.49, 90.5, 90.52, 90.65, 123/90.66, 90.67; 29/888.43; 74/559, 567, 74/569

See application file for complete search history.

(56) References Cited

U.S. PATENT DOCUMENTS 6,397,806 B2 * 6/2002 Imai et al. ..... 123/90.48

FOREIGN PATENT DOCUMENTS

JP 2001-65318 A 3/2001

* cited by examiner

*Primary Examiner*—Ching Chang
(74) *Attorney, Agent, or Firm*—Birch, Stewart, Kolasch & Birch, LLP

(57) ABSTRACT

To provide an inner shim that is unlikely to fall off from a spring retainer even when an anomalous operation of a valve occurs. A spring retainer fixed to the upper end portion of a valve shaft has a shim-attachment hole. An inner shim is fitted into the shim-attachment hole. The bottom face of the inner shim is in contact with the upper end portion of the valve shaft, and the top face of the inner shim is positioned below the upper edge of the shim-attachment hole. A tappet is disposed above the spring retainer, and is allowed to move freely in the axial direction of the valve shaft. A shim-holding projection sticks out from the under face of the tappet, and extends downward. The projection enters, from above, the inside of the shim-attachment hole, and is in contact with the top face of the inner shim.

10 Claims, 3 Drawing Sheets

VALVE MECHANISM OF ENGINE

CROSS-REFERENCE TO RELATED APPLICATIONS

This nonprovisional application claims priority under 35 U.S.C. § 119(a) on Patent Application No. 2006-121637, filed in Japan on Apr. 26, 2006, the entirety of which is incorporated herein by reference.

BACKGROUND OF THE INVENTION

1. Field of the Invention

The present invention relates to a valve mechanism used in the intake and the exhaust systems of an engine.

2. Background of the Invention

Each of an intake and exhaust systems that an engine is equipped with includes a valve mechanism. The valve mechanism includes a valve, a shaft (a valve stem) that is supported by a cylinder head and that moves in the axial direction of the valve shaft to open and close the intake, or the exhaust, port. The valve mechanism also includes a spring retainer attached to the upper end portion of the valve shaft, and a valve spring disposed between the spring retainer and the cylinder head to push up the valve in such a direction as to close the port. The valve mechanism additionally includes a tappet (which is also called a valve-lifter), provided above the spring retainer while being capable of freely moving in the axial direction of the valve shaft. Also included is a cam mechanism, which, against the biasing force of the valve spring, pushes the valve down (or actually, pushes directly the tappet down) in such a direction as to open the port.

There is a space that exists between the top face of the tappet and the cam face in a state where the port is completely closed by the valve. The distance of the space is called valve clearance. The valve clearance in the above-described valve mechanism can be adjusted by an inner shim that is set between the upper end portion of the valve shaft and the under face of the tappet. The inner shim is a disc-shaped metal member. The valve clearance is adjusted by altering the distance between the upper end portion and the under face. To alter the distance, the thickness of the inner shim has to be changed by replacing an inner shim with another shim having a different thickness. A hole is formed in the spring retainer to attach a shim (hereafter, the hole is referred to as shim-attachment hole). While the upper end of the valve shaft serves as the bottom base of the shim-attachment hole, the shim-attachment hole has an open end on the upper side. To attach the inner shim, the inner shim is fitted into the shim-attachment hole from above. At this time, the bottom face of the inner shim is in contact with the top face of the valve shaft, while the top face of the inner shim is in contact with the bottom face of the tappet (for example, see Japanese Patent Application Laid-Open No. 2001-65318).

SUMMARY OF THE INVENTION

As described above, the inner shim is fitted into the shim-attachment hole of the spring retainer from above, while its bottom face is in contact with the upper end portion of the valve shaft, and its top face is in contact with the under face of the tappet. Accordingly, the inner shim never falls off from the spring retainer (or from the shim-attachment hole) while the valve operates normally. On the other hand, the inner shim may possibly fall off from the spring retainer once the valve operates anomalously. Such anomalous operation of the valve (for example, jump, bounce and the like) is caused by, for example, anomalous combustion of the engine, such as a backfire. When such anomalous operation of the valve happens, the tappet does not operate in synchronization with the operation of the valve. The inner shim leaves the spring retainer to float loose in the air while the under face of the tappet and the top face of the inner shim remain in contact with each other.

The present invention has been made in view of the problem described above, and has an object of providing a valve mechanism of an engine with a configuration in which the inner shim is unlikely to fall off from the spring retainer even in a case where an anomalous combustion of the engine causes an anomalous operation of the valve.

A valve mechanism according to an aspect of the present invention includes a valve that has a shaft supported by the cylinder head. The valve moves in the axial direction of the valve shaft to open and close a port (for example, an intake port 18*a* in an embodiment). The valve mechanism also includes a spring retainer, which is fixed to the upper end portion of the valve shaft, and in which a shim-attachment hole is formed. The shim-attachment hole has an open end on the upper side, while the upper end of the valve shaft serves as the base face of the shim-attachment hole. In addition, the valve mechanism includes an inner shim, which is fitted into the shim-attachment hole of the spring retainer from above. The bottom face of the inner shim is in contact with the upper end portion of the valve shaft, while the top face of the inner shim is positioned below the upper edge of the shim-attachment hole. Moreover, the valve mechanism includes a tappet, which is provided above the spring retainer while being capable of freely moving in the axial direction of the valve shaft. A protruding portion (for example, a shim-holding protrusion 45*c* in an embodiment) extends downward while sticking out of the under face of the tappet. The protruding portion enters the shim-attachment hole from above, and, in that state, is in contact with the top face of the inner shim.

Here, in the above-mentioned valve mechanism of an engine, a plurality of convex portions are preferably formed on the inner circumferential surface of the shim-attachment hole, that is in contact with the outer circumferential surface of the inner shim. In addition, the upper edge of the shim-attachment hole is preferably formed by a protruding portion, which sticks out upward in a cylindrical shape.

In the valve mechanism according to an aspect of the present invention, when the inner shim is fitted into the shim-attachment hole of the spring retainer, the top face of the inner shim is made to be positioned below the upper edge of the shim-attachment hole, and the inner shim is held securely inside the shim-attachment hole. Accordingly, it is very unlikely that the inner shim might fall off from the shim-attachment hole not only when the valve operates normally, but also even when an anomalous combustion of engine or the like causes an anomalous operation of the valve.

Additionally, in the valve mechanism according to an aspect of the present invention, a plurality of convex portions may be formed, as sticking out toward the center of the shim-attachment hole, on the inner circumferential surface of the shim-attachment hole, which surface is in contact with the outer circumferential surface of the inner shim. When such convex portions are formed, the friction between the inner circumferential surface of the shim-attachment hole and the outer circumferential surface of the inner shim can be increased, and the inner shim is held inside the shim-attachment hole more strongly. Accordingly, the inner shim can be prevented from falling off from the spring retainer (or from the shim-attachment hole) with more certainty.

Moreover, in the valve mechanism according to an aspect of the present invention, the upper edge of the shim-attachment hole may be formed as a cylindrical-shaped protruding portion sticking out upwardly. In so doing, the spring retainer can be made lighter in weight by raising only a part of the spring retainer corresponding to the upper portion of the shim-attachment hole. To be more precise, only the portion surrounding the shim-attachment hole is raised to achieve the effect.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
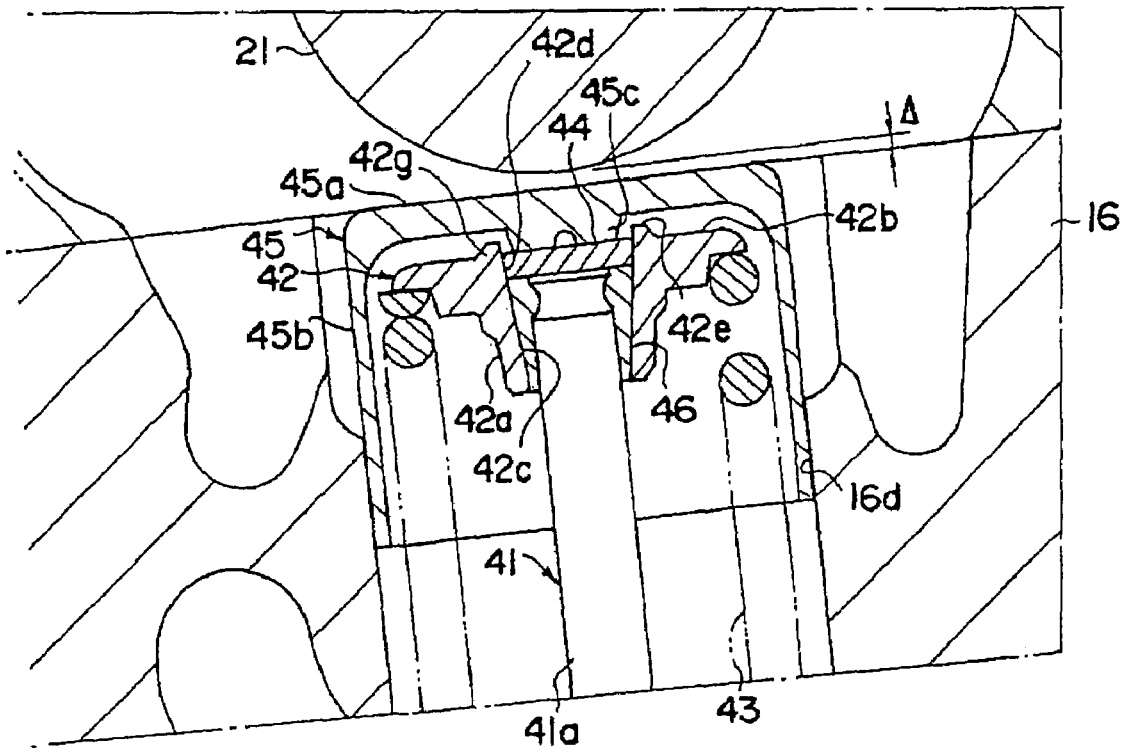
FIG. 1 shows a part of a valve mechanism of an intake valve in an engine equipped with a valve mechanism according to an embodiment of the present invention.

The present invention will now be described in detail with reference to the accompanying drawings, wherein the same reference numerals will be used to identify the same or similar elements throughout the several views.

Figure 2:
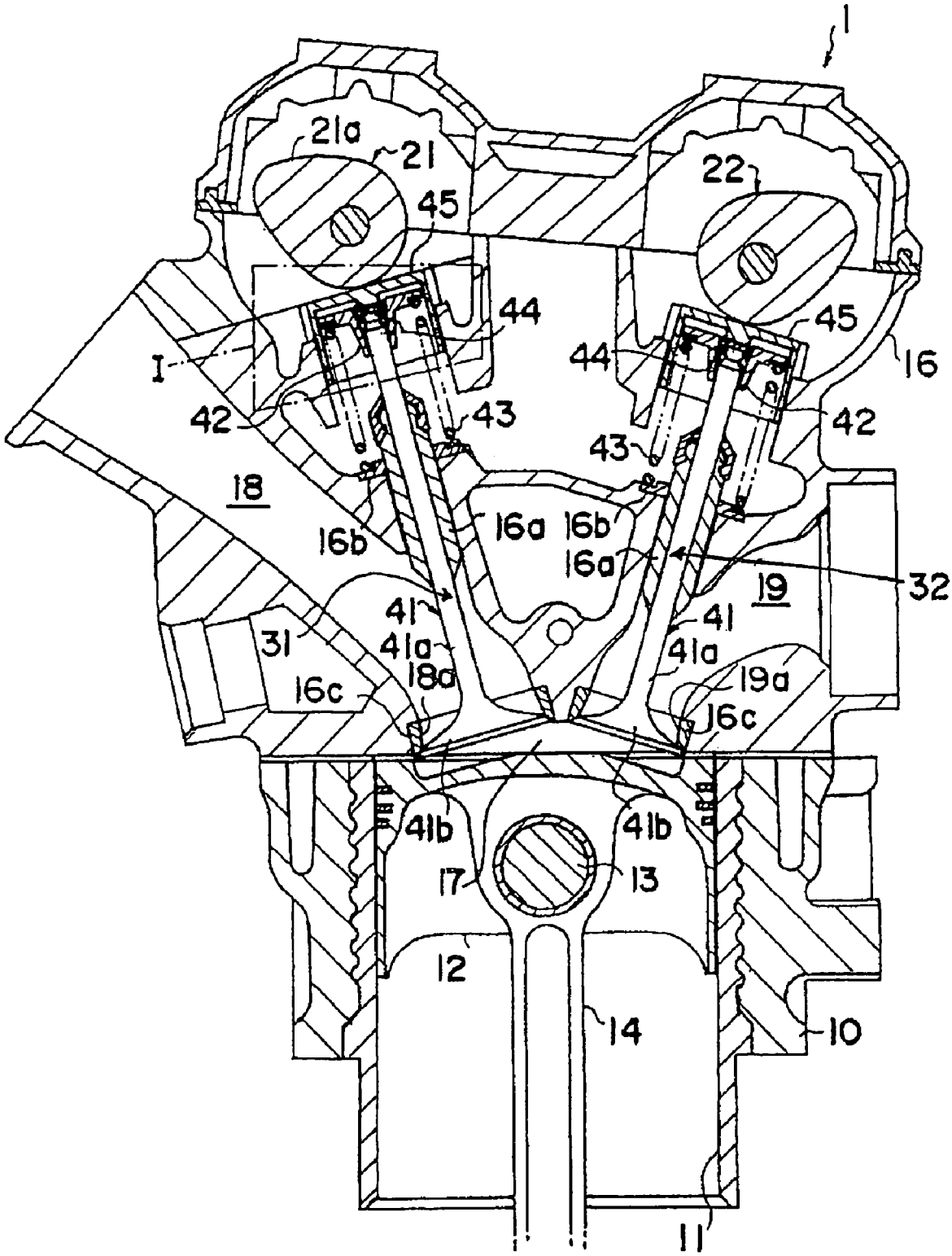
FIG. 2 is a cross-sectional view of a part of the engine.

Descriptions will be given below as to a preferred embodiment of a valve mechanism of an engine according to an aspect of the present invention. FIG. 2 shows a schematic configuration of an engine 1 equipped with a valve mechanism according to an embodiment of the present invention. The engine 1 is a type that would be mounted on, for example, a motorcycle. The engine 1 includes a cylinder block 10, a cylinder 11 formed in the cylinder block 10, and a piston 12, which is disposed in the cylinder 11. The upper end portion of a connecting rod 14 is attached to the piston 12 with a piston pin 13. The lower end of the connecting rod 14 is connected to an unillustrated crankshaft with a crank pin (not illustrated).

A cylinder head 16 is attached to the top portion of the cylinder block 10. A combustion chamber 17 is formed in a space that is formed by the cylinder head 16 and the cylinder 11, which face each other. An intake passage 18 and an exhaust passage 19 are formed in the cylinder head 16, and the two passages lead to the inside of the cylinder 11. An intake port 18*a* is disposed as a communicating portion between the cylinder 11 and the intake passage 18. An intake valve 31 opens and closes the intake port 18*a*. An exhaust port 19*a* is disposed as a communicating portion between the cylinder 11 and the exhaust passage 19. An exhaust valve 32 opens and closes the intake port 19*a*. Valve drive cams (an intake-side cam 21 and an exhaust-side cam 22) are provided to help the crankshaft to drive the intake valve 31 and the exhaust valve 32, respectively.

As FIG. 2 shows, each valve mechanism of the intake valve 31 and exhaust valve 32 includes a valve 41, a spring retainer 42, a valve spring 43, an inner shim 44 and a tappet 45. The description below as to the intake valve 31 will be given with reference also to FIG. 1, but the exhaust valve 32 has basically the same configuration as the intake valve 31.

The valve 41 is what is called a poppet valve, and includes a rod-like shaped valve shaft (valve stem) 41*a* and a disc-shaped pileus portion 41*b* provided at the bottom end of the valve shaft 41*a*. A tubular valve guide 16*a* is formed extending substantially in the up-and-down directions in the cylinder head 16. The valve shaft 41*a* extends inside the valve guide 16*a*. The pileus portion 41*b* is positioned below the bottom end portion of the valve guide 16*a*. The valve shaft 41*a* can move freely in the axial direction while the valve guide 16*a* guides the movement. As the valve shaft 41*a* moves in the axial direction, the pileus portion 41*b* opens and closes the intake port 18*a* (the exhaust port 19*a* in the case of the exhaust valve 32).

The spring retainer 42 includes a cylinder portion 42*a* extending in the up-and-down-direction (in the direction in which the valve shaft 41*a* extends), and a ring-shaped brim portion 42*b* extending outward (in directions perpendicular to the valve shaft 41*a*) from the cylinder portion 42*a*. A valve-shaft fixation hole 42*c* penetrates, as extending in the up-and-down direction, the cylinder portion 42*a* at the center. The valve-shaft fixation hole 42*c* is tapered downward. A cotter 46 is attached to the valve-shaft fixation hole 42*c*. The spring retainer 42 is fixed at the upper end portion of the valve shaft 41*a* with the cotter 46 interposed in between. The cotter 46 is a hollow member, and has a conical outer circumferential surface tapered downward. The upper end portion of the valve shaft 41*a* is press-fitted into the cotter 46, while the cotter 46 itself is press-fitted into the valve-shaft fixation hole 42*c*. The upper end portion of the valve shaft 41*a* is positioned inside the valve-shaft fixation hole 42*c*, in a state where the spring retainer 42 is fixed to the upper end portion of the valve shaft 41*a* with the cotter 46 interposed in between. In this state, the portion of the valve-shaft fixation hole 42*c* above the upper end portion of the valve shaft 41*a* serves as a shim-attachment hole 42*d*. The shim-attachment hole 42*d* has an open end on the upper side, while the upper end portion of the valve shaft 41*a* serves as the base face of the shim-attachment hole 42*d*. In addition, the portion surrounding the upper portion of the shim-attachment hole 42*d* is formed by a protruding portion 42*g*, which sticks out, extending upward in a cylindrical shape, from the top face of the brim portion 42*b*.

Inside the cylinder head 16, a spring seat 16*b* is provided at a position opposite the brim portion 42*b* of the spring retainer 42. The valve guide 16*a* penetrates the spring seat 16*b*. The valve spring 43 is provided, being compressed, between the spring seat 16*b* and the brim portion 42*b* of the spring retainer 42. The spring retainer 42 is fixed to the valve shaft 41*a* with the cotter 46 interposed in between. Accordingly, the valve 41 is in a state of being biased upward by the valve spring 43 via the spring retainer 42 and the cotter 46. At this time, the intake air port 18*a* (the exhaust port 19*a* in the case of the exhaust valve 32) is in a closed state (in the state as shown in FIG. 1) with the pileus portion 41*b* being in contact with a seat portion 16*c* of the intake port 18*a* from below.

The inner shim 44 is a disc-shaped metal member, and is fitted, from above, into the above-described shim-attachment hole 42*d* (the upper region of the valve-shaft fixation hole 42*c*) formed in the spring retainer 42. In a state where the inner shim 44 is fitted into the shim-attachment hole 42*d*, the bottom face of the inner shim 44 is in contact with the upper end portion of the valve shaft 41*a* while the top face of the inner shim 44 is positioned below an upper edge 42*e* of the shim-attachment hole 42*d* (below an upper surface of the protruding portion 42*g*).

The tappet 45 is a cylindrical member with a ceiling, and has an open end on the lower side. The tappet 45 includes a disc portion 45*a* extending in directions orthogonal to the axis of the valve shaft 41*a*, and a cylinder portion 45*b* extending downward from the outer periphery portion of the disc portion 45*a*. A tappet passage 16*d* is formed above the spring retainer 42 inside the cylinder head 16, coaxially with the valve shaft 41*a*. The cylinder portion 45*b* of the tappet 45 can freely move in the axial direction of the valve shaft 41*a* inside the tappet passage 16*d*. The spring retainer 42 and the upper portion of the valve spring 43 are housed inside the cylinder portion 45*b* of the tappet 45. A shim-holding projection 45*c* is formed, sticking out and extending downward, at the center of the under face of the disc portion 45*a* of the tappet 45. The shim-holding projection 45*c* enters, from above, the inside of the shim-attachment hole 42*d* of the spring retainer 42, and, in this state, the shim-holding projection 45*c* is in contact with the top face of the inner shim 44.

Every two reciprocating motions of the piston 12 give a rotation of the intake-side cam 21. During the rotation, a convex portion (nose portion) 21 a presses down the top face of the tappet 45 (the top face of the disc portion 45*a*), and thus the tappet 45 pushes down the upper end portion of the valve shaft 41*a* via the inner shim 44. Accordingly, the valve 41 moves downward against the biasing force of the valve spring 43 to open the intake port 18*a* (the exhaust port 19*a* in the case of the exhaust valve 32). It should be noted that, while the valve 41 is moving downward, the upward biasing force of the valve spring 43 keeps on acting on the valve 41 via the spring retainer 42 and the cotter 46. Accordingly, once the valve 41 opens the intake port 18*a* to the full extent, the valve 41 alters the direction and moves upward. Thereafter, the intake port 18*a* is closed.

In a state where the valve 41 closes the intake port 18*a* completely (the state as shown in FIGS. 1 and 2), there is a space between the top face of the tappet 45 and the outer circumferential surface of the intake-side cam 21. The distance of the space, that is, the valve clearance Δ can be adjusted to a desired value by changing the thickness of the inner shim 44. Specifically, when the inner shim 44 is thick, the valve clearance Δ becomes small. When the inner shim 44 is thin, the valve clearance Δ becomes large.

As has been described above, when the intake-side cam 21 presses down the tappet 45, the tappet 45 pushes the inner shim 44 downward with the shim-holding projection 45*c*, and pushes, indirectly via the inner shim 44, the valve shaft 41*a* downward. On the other hand, when the valve spring 43 pushes the valve shaft 41*a* back upward, the valve shaft 41*a* pushes up the inner shim 44, and, indirectly via the inner shim 44, pushes upward the shim-holding projection 45*c* of the tappet 45. Accordingly, when the valve 41 operates normally, the inner shim 44 is held between the tappet 45 and the upper end portion of the valve shaft 41*a*, so that the inner shim 44 does not fall off from the shim-attachment hole 42*d* of the spring retainer 42. On the other hand, when an anomalous combustion, such as a backfire, takes place in the engine 1, tappet 45 sometimes moves not in synchronization with the valve 41 (for example, jump, bounce and the like). In this case, while the top face of the inner shim 44 is in contact with the shim-holding projection 45*c* of the tappet 45, the inner shim 44 might leave the spring retainer 42 to float loose in the air, and might go outside (above) the shim-attachment hole 42*d*. The inner shim 44, however, is disposed, as described above, with its top face being positioned below the upper edge 42*e* of the shim-attachment hole 42*d*, and is securely held inside the shim-attachment hole 42*d*. As a result, even when an anomalous combustion of the engine 1 or the like causes an anomalous operation of the valve 41 as mentioned above, the inner shim 44 is very unlikely to fall off from the shim-attachment hole 42*d*.

Figure 3A:
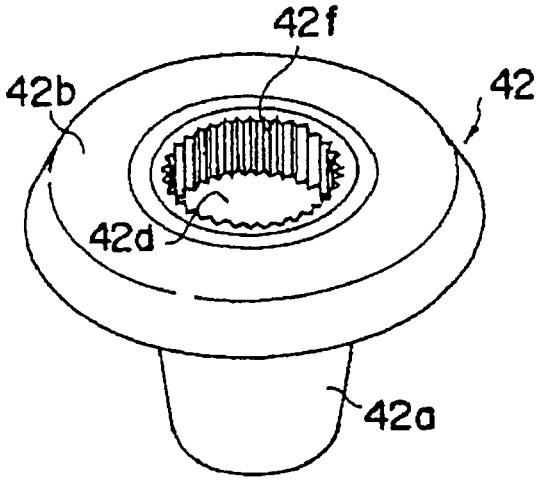
FIGS. 3A to 3C show examples in each of which convex portions are formed on the inner circumferential surface of a shim-attachment hole in a spring retainer.
Figure 3B:
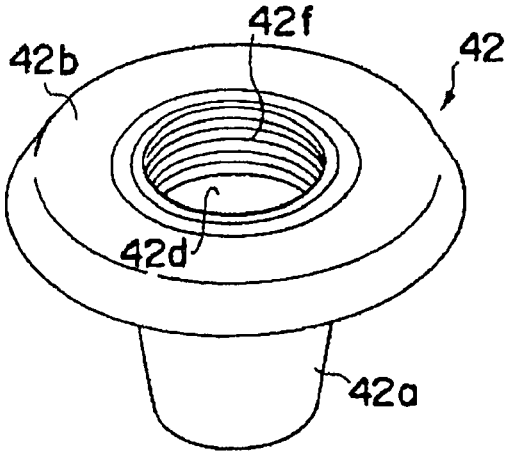
Figure 3C:
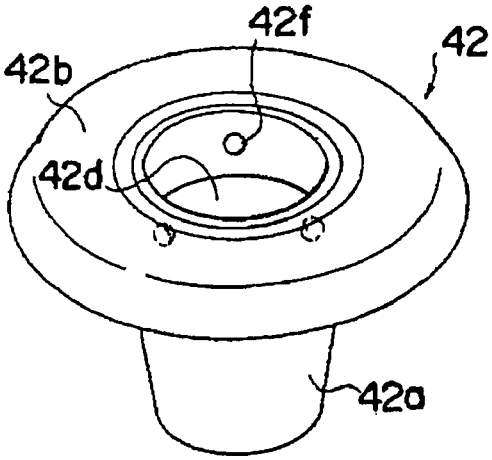

Suppose that, as FIGS. 3A to 3C show, on the inner circumferential surface of the shim-attachment hole 42*d* with which the outer circumferential surface of the inner shim 44 is in contact, a plurality of convex portions 42*f* are formed, sticking out toward the center of the shim-attachment hole 42*d*. In this case, the friction between the inner circumferential surface of the shim-attachment hole 42*d* and the outer circumferential surface of the inner shim 44 can be made larger, and the inner shim 44 can be held inside the shim-attachment hole 42*d* more strongly. Accordingly, the inner shim 44 can be prevented from falling off from the spring retainer 42 (from the shim-attachment hole 42*d*) with more certainty. FIG. 3A shows an example in which the convex portions 42*f* (a lot of them, actually) are formed in an array side by side with each other in the inner circumferential direction of the shim-attachment hole 42*d*. Each convex portion 42*f* with a triangle cross-section extends in the up-and-down directions, and sticks out towards the center of the shim-attachment hole 42*d*. FIG. 3B shows another example in which the convex portions 42*f* (a plurality of them, actually) are formed in an array side by side with each other in the up-and-down directions. Each convex portion 42*f* with a triangle cross-section extends in the inner circumferential direction of the shim-attachment hole 42*d*, and sticks out towards the center of the shim-attachment hole 42*d*. FIG. 3C shows still another example in which the convex portions 42*f* (actually, a plurality of, specifically, three in this example) are formed in an array with large intervals in between along the inner circumferential surface of the shim-attachment hole 42*d*. Each convex portion has a bump shape, and sticks out towards the center of the shim-attachment hole 42*d*.

Incidentally, as described before, the upper part of the spring retainer 42 surrounding the shim-attachment hole 42*d* may be formed by the protruding portion 42*g* extending upward in a cylindrical shape from the brim portion 42. In so doing, only the portion surrounding the shim-attachment hole 42*d* is raised higher than the rest, so that the spring retainer 42 can be made lighter in weight.

A preferable embodiment of the present invention has been described thus far, but the scope of the present invention is not limited to what has been shown in the above-described embodiment. For example, the shape of the spring retainer 42 as shown in the above-described embodiment is just an example. So is the structure by which the spring retainer 42 is fixed to the upper end portion of the valve shaft 41*a*, and so is the structure by which the shim-attachment hole 42*d* is formed. The spring retainer 42 only has to be fixed to the upper end portion of the valve shaft 41*a*. The shim-attachment hole 42*d* may have other forms than the one shown in the above example as long as the upper end portion of the valve shaft 41*a* serves as the base face of the shim-attachment hole 42*d*, and has an open end on the upper side. In addition, the plurality of convex portions 42*f*, which are formed on the inner circumferential surface of the shim-attachment hole 42*d*, only have to stick out towards the center of the shim-attachment hole 42*d*, that is to say, the forms of the convex portions 42*f* are not limited to the examples shown in FIGS. 3A to 3C.

Moreover, in the example shown in the above embodiment, the present invention is applied to an engine for motorcycles.

The present invention; however, is not limited to an engine for motorcycles, but can be applied to various engines for other usages.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A valve mechanism of an engine, comprising:

a valve, said valve including a valve shaft supported by a cylinder head of the engine, said valve opening and closing a port by moving in an axial direction of the valve shaft;

a spring retainer, said spring retainer being fixed to an upper end portion of the valve shaft, said spring retainer including a shim-attachment hole having an open end on an upper side thereof, an upper end portion of the valve shaft serving as a base face of the shim-attachment hole;

an inner shim, said inner shim being fitted into the shim-attachment hole of the spring retainer from above, a bottom face of said inner shim being in contact with the upper end portion of the valve shaft, and a top face of said inner shim being positioned below an upper edge of the shim-attachment hole; and a tappet, said tappet being disposed above the spring retainer and being capable of moving freely in the axial direction of the valve shaft, said tappet having a protruding portion sticking out of an under face of the tappet and extending downward, the protruding portion being brought into contact with the top face of the inner shim when the protruding portion enters the shim-attachment hole from above.

2. The valve mechanism of an engine according to claim 1, wherein, on an inner circumferential surface of the shim-attachment hole, with which an outer circumferential surface of the inner shim is in contact, a plurality of convex portions are formed sticking out towards a center of the shim-attachment hole.

3. The valve mechanism according to claim 2, wherein an upper edge of the shim-attachment hole is formed by a cylindrical protruding portion sticking out upward.

4. The valve mechanism according to claim 1, wherein an upper edge of the shim-attachment hole is formed by a cylindrical protruding portion sticking out upward.

5. The valve mechanism according to claim 1, wherein said spring retainer includes:

a cylinder portion extending in the axial direction of the valve shaft;

a ring-shaped brim portion extending outward from the cylinder portion in a generally perpendicular direction from the axial direction of the valve shaft; and a valve shaft fixation hole penetrating the cylinder portion at a center thereof.

6. The valve mechanism according to claim 5, wherein said valve shaft fixation hole includes a cotter press-fit therein, the upper end portion of the valve shaft being press-fit in the cotter to secure the valve shaft to the spring retainer.

7. The valve mechanism according to claim 6, wherein an upper edge of the shim-attachment hole is formed by a cylindrical protruding portion extending upwardly from an upper surface of the ring-shaped brim portion, and the top face of the inner shim is located below a top of the cylindrical protruding portion.

8. The valve mechanism of an engine according to claim 6, wherein, on an inner circumferential surface of the shim-attachment hole, with which an outer circumferential surface of the inner shim is in contact, a plurality of convex portions are formed sticking out towards a center of the shim-attachment hole.

9. The valve mechanism according to claim 5, wherein an upper edge of the shim-attachment hole is formed by a cylindrical protruding portion extending upwardly from an upper surface of the ring-shaped brim portion, and the top face of the inner shim is located below a top of the cylindrical protruding portion.

10. The valve mechanism of an engine according to claim 5, wherein, on an inner circumferential surface of the shim-attachment hole, with which an outer circumferential surface of the inner shim is in contact, a plurality of convex portions are formed sticking out towards a center of the shim-attachment hole.

* * * * *